US010132586B1

(12) United States Patent
Hoekema

(10) Patent No.: US 10,132,586 B1
(45) Date of Patent: Nov. 20, 2018

(54) SOFT PULL TRIGGER MECHANISM AND METHOD OF OPERATION THEREOF

(71) Applicant: Roy Hoekema, Wasilla, AK (US)

(72) Inventor: Roy Hoekema, Wasilla, AK (US)

( * ) Notice: Subject to any disclaimer, the term of this patent is extended or adjusted under 35 U.S.C. 154(b) by 0 days.

(21) Appl. No.: 15/602,575

(22) Filed: May 23, 2017

(51) Int. Cl.
*F41A 19/29* (2006.01)
*F41A 19/10* (2006.01)
*F41A 19/13* (2006.01)

(52) U.S. Cl.
CPC ..... *F41A 19/29* (2013.01); *F41A 19/10* (2013.01); *F41A 19/13* (2013.01)

(58) Field of Classification Search
CPC ..... F41A 19/10; F41A 19/13; F41A 19/25; F41A 19/27; F41A 19/29; F41A 19/30; F41A 19/31; F41A 19/32
USPC ..... 42/69.01; 89/27.11
See application file for complete search history.

(56) References Cited

U.S. PATENT DOCUMENTS 3,234,679 A * 2/1966 Benson ..... F41A 3/24 42/16
4,908,970 A * 3/1990 Bell ..... F41A 19/12 42/69.01
5,363,581 A * 11/1994 Blenk ..... F41A 19/31 42/69.02
5,852,891 A * 12/1998 Onishi ..... F41A 19/17 42/69.01
9,671,186 B1 * 6/2017 Hoekema ..... F41A 19/17
2010/0175291 A1 * 7/2010 Farley, Jr. ..... F41A 19/10 42/69.01
2011/0277367 A1 * 11/2011 Krieger ..... F41A 19/10 42/69.01
2012/0227301 A1 * 9/2012 Simmons ..... F41A 19/10 42/69.01
2015/0144117 A1 * 5/2015 Khoshnood ..... F41B 5/10 124/25
2016/0047615 A1 * 2/2016 Tubb ..... F41A 17/56 42/69.01
2016/0305730 A1 * 10/2016 Dextraze ..... F41A 19/10
2016/0377363 A1 * 12/2016 Lipowski ..... F41A 19/10 42/69.01

* cited by examiner

*Primary Examiner* — Bret Hayes
(74) *Attorney, Agent, or Firm* — Michael J. Tavella

(57) ABSTRACT

An encasement that is designed to hold a trigger and the trip mechanism directly on the firing pin. In this invention, the trip mechanism consists of a trigger, a tripper, which is in contact with the trigger and a trip, which is attached to the tripper and is designed to pivot when firing the firearm. An adjustment pin is provided to set the tension on the trigger and tripper so that a minimum force is required to hold the assembly in the cocked position, ready for firing. The length and shape of the tripper as well as the encasement body are all designed based on the type of firearm that the action is installed. This is to allow the trip to fit against the firing pin as a sear would. The encasement must also be designed to fit into the existing structure of the firearm.

2 Claims, 6 Drawing Sheets

SOFT PULL TRIGGER MECHANISM AND METHOD OF OPERATION THEREOF

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to trigger mechanisms and particularly to trigger mechanisms having a soft pull.

2. Description of the Prior Art

In competitive target shooting, accuracy is paramount. Competitors work to ensure that their guns are tuned as precisely as possible. However, despite all of the work done to improve the accuracy of the gun, the final aiming and execution of the shot is literally in the hands of the shooter. A conventional trigger, with a harder pull, can affect the accuracy of the gun simply in the act of firing it. As explained in my previous application, now U.S. Pat. No. 9,671,186, I designed a system that eased the sear down in a smooth motion, rather than the hard drop in existing firearms. That hard drop often caused a slight movement of the gun, which affected the aim. In competition, slight movements such as this can be the difference between a victory and a lesser place finish. FIG. 1 shows the construction of my first design 100, as prior art. In that design, a sear block 103 is shown aligned with a firing pin 105, when cocked. Note how the top bearing 101 of the trip rests in a recess 106 of the sear block 103. This allows the sear block to remain in a horizontal position and to allow the firing pin retainer 107 to retain the firing pin 105. When the trigger is pulled, the top bearing 101 is rolled off the recess 106, which allows the sear to pivot down, which releases the firing pin.

BRIEF DESCRIPTION OF THE INVENTION

The instant invention uses an encasement that is designed to hold the trigger and the trip mechanism such that the mechanism eliminates the sear. The top bearing of the trip now rests directly on the firing pin. This simplifies the design of the action considerably. In this invention, the trip mechanism consists of a trigger, a tripper, which is in contact with the trigger and a trip, which is attached to the tripper and is designed to pivot when firing the firearm. An adjustment pin is provided to set the tension on the trigger and tripper so that a minimum force is required to hold the assembly in the cocked position, ready for firing. The length and shape of the tripper as well as the encasement body are all designed based on the type of firearm in which the action is installed. This is to allow the trip to fit against the firing pin as a sear would. The encasement must also be designed to fit into the existing structure of the firearm.

DETAILED DESCRIPTION OF THE INVENTION

Figure 1:
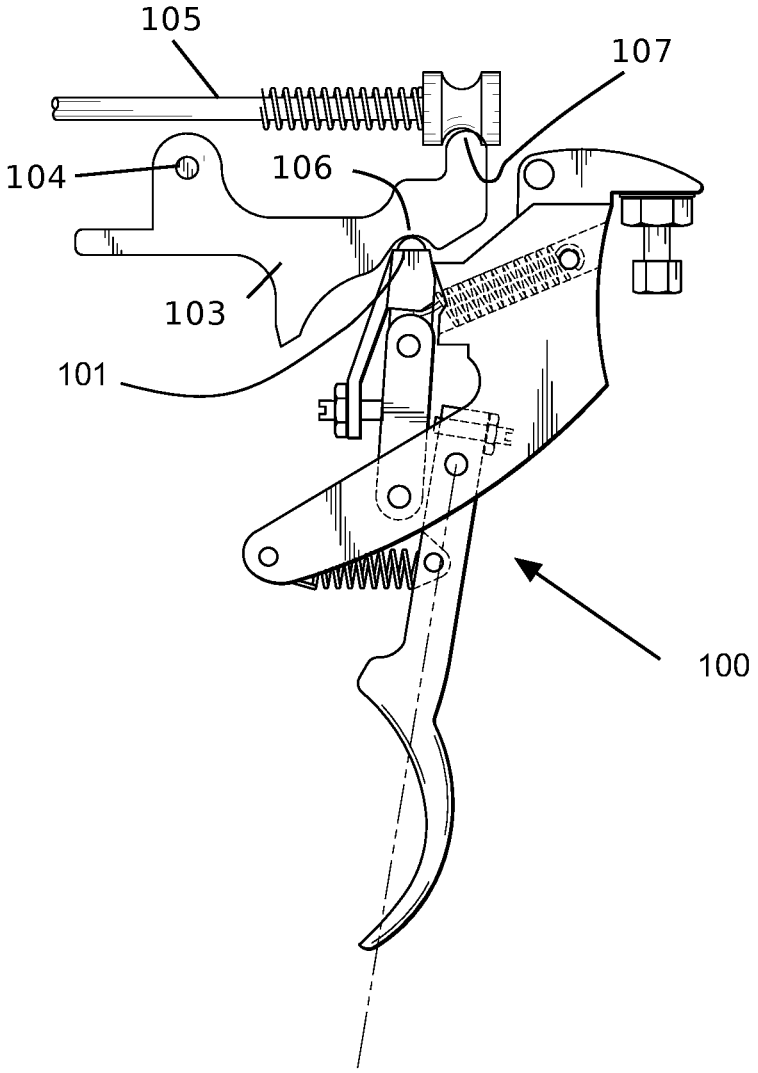
Figure 1 Prior Art
FIG. 1 is a detail view of my original design as prior art.
Figure 2:
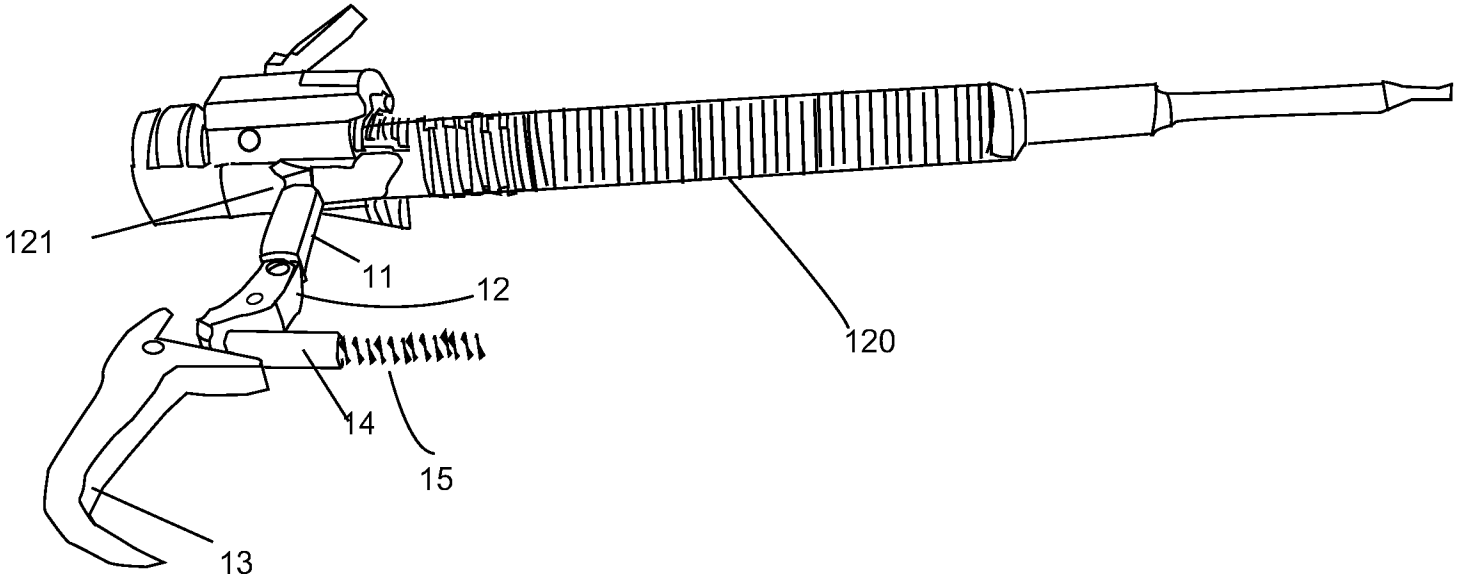
FIG. 2 is detail view of a firing pin showing the placement of the main components of my new system with respect to that firing pin.

Referring now to FIG. 2, the essential elements of the invention 10 are shown. In this view, a firing pin 120 is shown. A ridge 121 is formed as shown. That ridge is used to hold the firing pin back when the firearm is cocked. Normally, this is accomplished using a sear, as discussed above. In the instant invention, this is accomplished by the trip 11. A tripper 12 is pivotably attached to the bottom of the trip 11 as shown. A trigger 13 is positioned as shown. When pulled, it releases the tripper and causes the trip to rotate forward, releasing the firing pin. A pin 14 and tension spring 15 are used to adjust the tension on the trigger, as discussed below.

Figure 3:
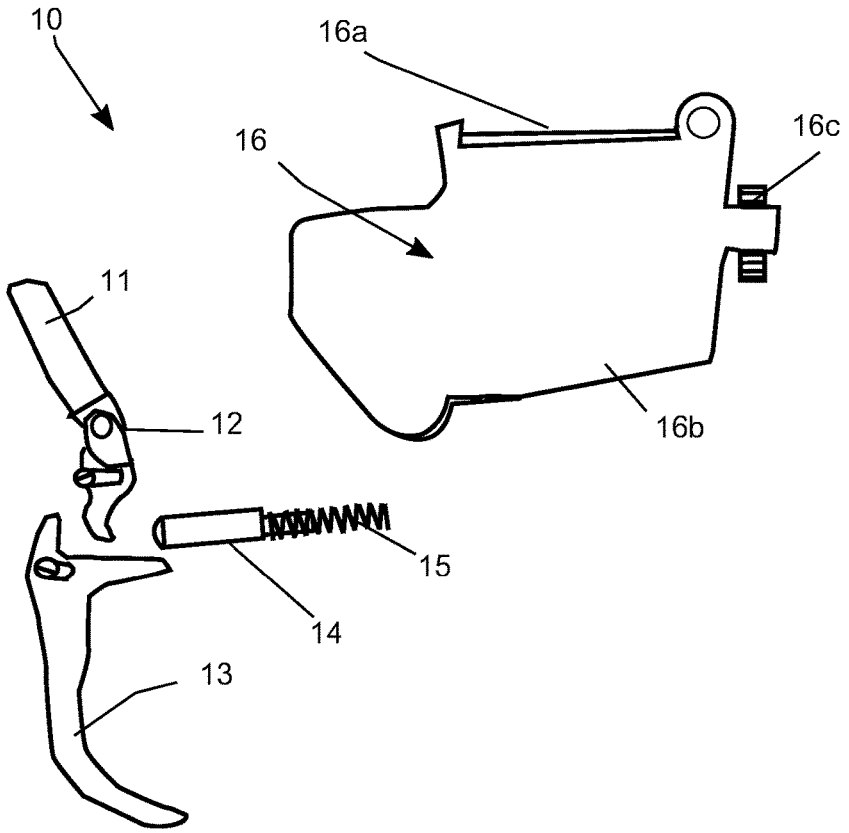
FIG. 3 is a detail side view of the components of my new system in an exploded form.

FIG. 3 is a detail side view of the components of my new system in an exploded form. In this view, the device 10 is shown in pieces. The trip 11, the tripper 12 and the trigger 13 are shown along with the tension pin 14 and spring 15. Also, here, the encasement 16 is shown. The encasement has a double wall (wall **16*a* is shown in the rear and wall 16*b* is shown in front). The encasement also has an adjustment screw 16*c*, which is discussed below. When assembled, the trip 11, the tripper 12 and the trigger 13 are assembled between the two walls of the encasement, as discussed below (see e. g., FIG. 6**).

Figure 4:
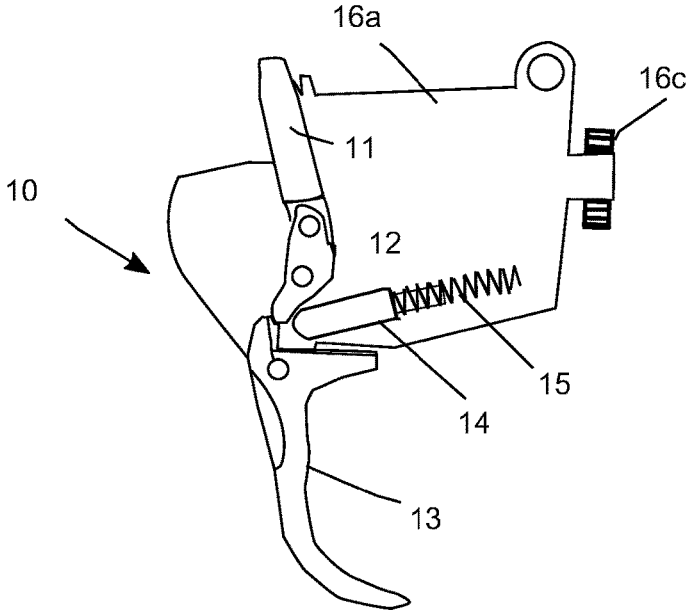
FIG. 4 is a side detail view of the components assembled in one-half of the encasement with the gun cocked.

FIG. 4 is a side detail view of the components assembled in one-half of the encasement with the gun cocked. In this figure, the trip 11, the tripper 12 and the trigger 13 are shown assembled within the encasement (note, only one wall **16*a* is shown). In practice, the trigger extends below the encasement and the top of the trip 11*a* extends above the encasement. Note that the tripper 12 is secured to the encasement with a pin (see e. g., FIG. 5), which allows it to pivot in place. Note too that the trip 11 is connected to the tripper by a pin 11*b* as shown. This allows the trip to pivot when the gun is fired. Note that in this view, the gun is cocked and the top 11a of the trip 11** is positioned against the firing pin.

This figure also shows the trigger 13, which is not connected to the tripper; however, it does contact the tripper. At the top of the trigger is a spur **13*a* that abuts the tripper when the gun is cocked, as shown. Note the tension pin 14 in position against the tripper. This pin is set (using a screw (not shown)) by tightening the spring 15**.

Figure 5:
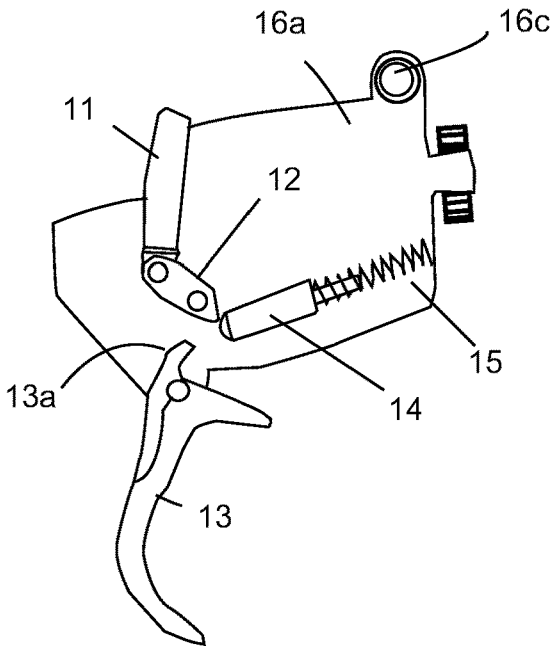
FIG. 5 is side detail view of the components assembled in one-half of the encasement with the gun fired.

FIG. 5 is side detail view of the components assembled in one-half of the encasement with the gun fired. As the trigger 13 is pulled, it rotates backwards, which causes the spur **13*a*** to push the tripper forwards. This causes the trip to rotate forward, which releases the firing pin. The firing operation is smooth and gentle, with no hard snapping action as found in traditional prior art firearms.

Figure 6:
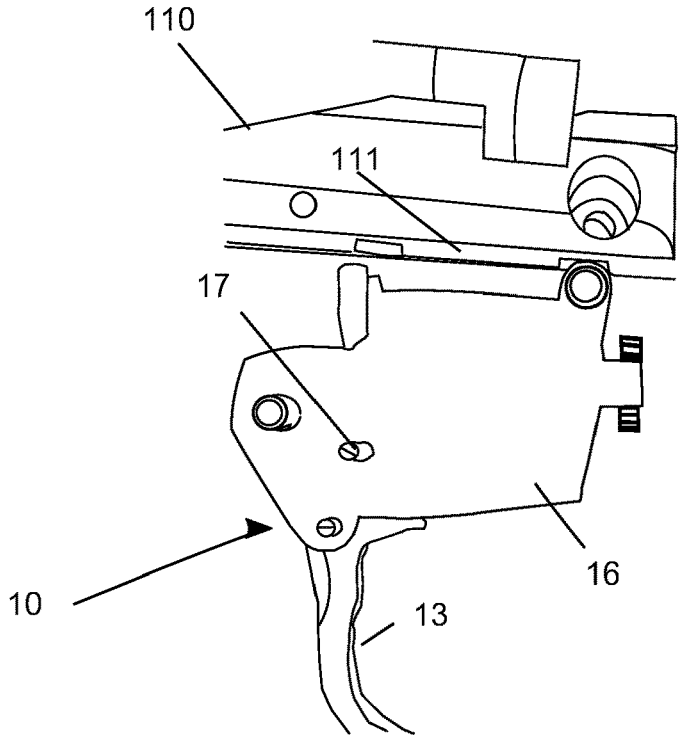
FIG. 6 is a detail view of a fully assembled encasement aligned for insertion into a firearm.
Figure 7:
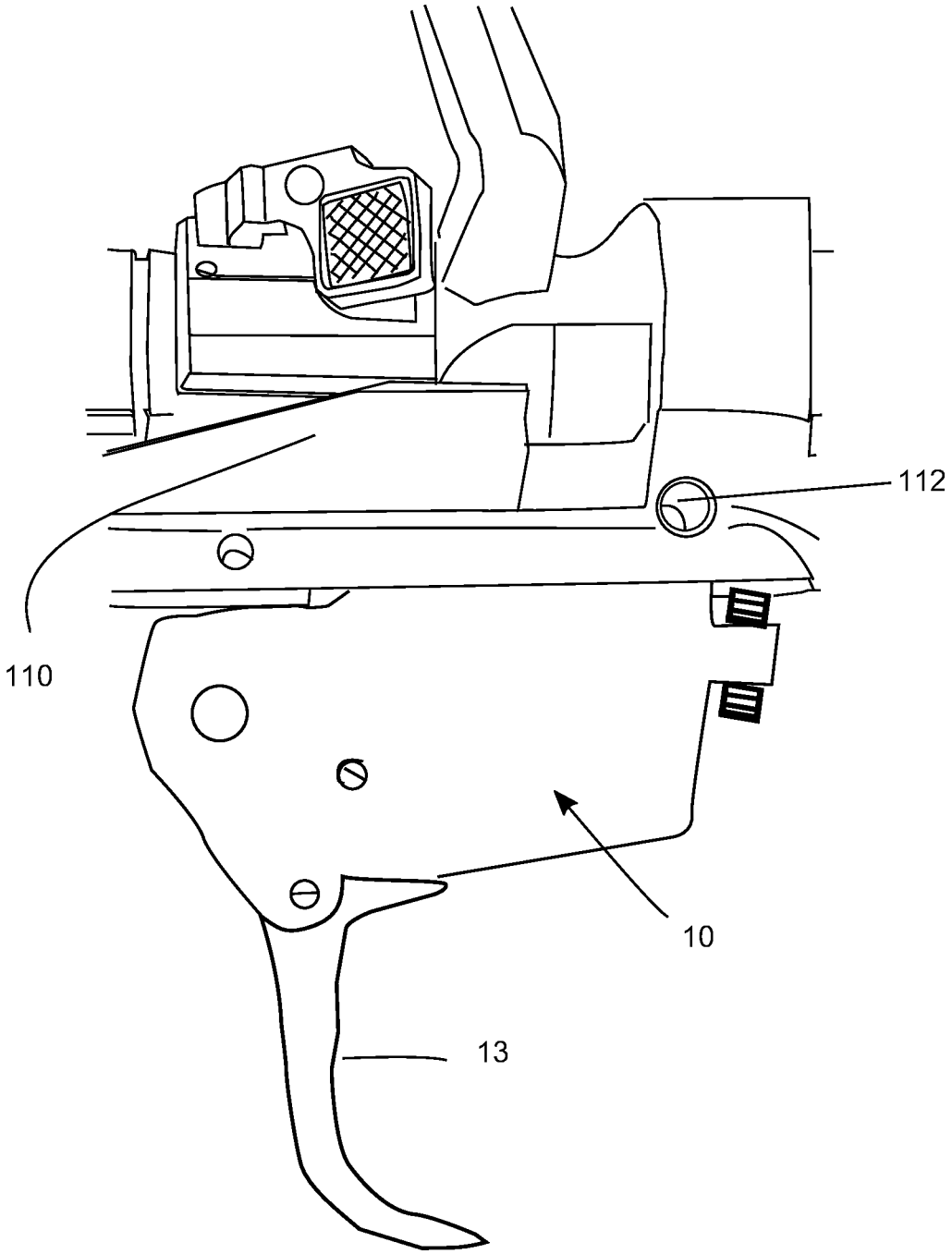
FIG. 7 is a detail view of the assembled mechanism fully installed in a rifle.
Figure 8:
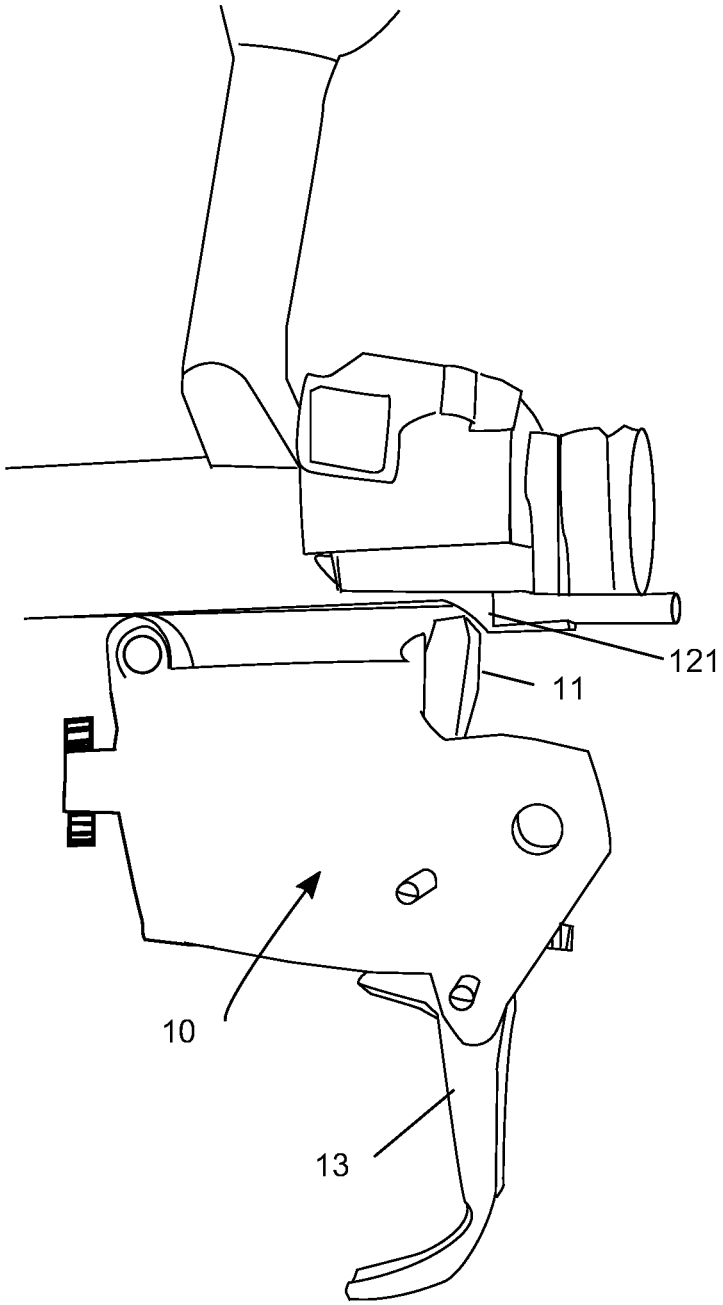
FIG. 8 is a reverse detail view of the assembled mechanism showing the position of the trip against the firing pin assembly of a firearm.

FIG. 6 is a detail view of a fully assembled encasement aligned for insertion into a firearm. Here, the unit 10 is fully assembled. Note the pins 17 and 18 that hold the trigger and the tripper. Note the encasement wall 16*b*. This figure also shows the lower portion of a firearm 110 at the bottom is a slot 111 that receivers the assembled unit 10. FIG. 7 is a detail view of the assembled mechanism fully installed in a rifle. In this figure, the unit is placed within the firearm. Note that the lower portion remains below. Note that the hole 112 aligns with the hole 16*d* on the encasement. This allows the unit to be held in place by a screw (not shown). Note too, the adjustment screw 16*c*. It abuts the bottom of the firearm as shown. It can be adjusted to ensure a snug fit of the unit into the firearm. FIG. 8 is a reverse detail view of the assembled mechanism 10 showing the position of the trip 11 against the firing pin 120 of a firearm.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A soft pull trigger mechanism for a firearm having a firing pin, comprising:

a) an encasement having oppositely disposed first and second walls such that said first and second walls have a space therebetween;

b) a trip having a top and a bottom, said trip being positioned in a generally vertical orientation in said encasement wherein the top of said trip extends upward through said encasement, and being pivotably attached to said encasement and extending upwardly therefrom, said trip having a cocked position and a fired position and further wherein when said encasement is installed in a firearm, and said trip is in a cocked position, said trip is in direct contact with said firing pin;

c) a tripper, having a top and a bottom and being pivotably connected to said encasement such that the top of said tripper is mechanically attached to the bottom of said trip;

d) a trigger, being pivotably attached to said encasement, said trigger having a top spur such that when said trip is in said cocked position, said top spur on said trigger abuts the bottom of said tripper; and e) a pin, and a tension spring, positioned about said pin, and extending rearwardly therefrom, said pin and tension spring being installed in said encasement such that said pin abuts said top spur of said trigger and, when said trigger is in said cocked position, said pin also contacts said tripper.

2. A method of firing a firearm having an encasement, a trip having a top and a bottom, said trip being pivotably attached to said encasement and extending upwardly therefrom, said trip having a cocked position and a fired position and further wherein when said encasement is installed in a firearm, and said trip is in a cocked position, said trip is in a vertical position such that the top of said trip is in direct contact with a firing pin, a tripper, having a top and a bottom and being pivotably connected to said encasement such that the top of said tripper is mechanically connected to the bottom of said trip, and a trigger, being pivotably attached to said encasement, said trigger having a top spur such that when said trip is in said cocked position, said top spur on said trigger abuts the bottom of said tripper, and further having a pin, and a tension spring, positioned about said pin, and extending rearwardly therefrom, said pin and tension spring being installed in said encasement such that said pin abuts said top spur of said trigger and, when said trigger is in said cocked position, said pin also contacts said tripper, comprising the steps of:

a) cocking said firearm by setting the trip into the cocked position against the firing pin, such that said pin abuts said top spur of said trigger and said pin also contacts said tripper;

b) pulling said trigger rearwards, which causes said spur on said trigger to push the bottom of said tripper forward; and c) causing said trip to rotate forwards causing said firing pin to be released from said trip, which causes said firearm to discharge.

* * * * *